US010882102B2

(12) United States Patent
Comand et al.

(10) Patent No.: US 10,882,102 B2
(45) Date of Patent: Jan. 5, 2021

(54) APPARATUS TO REPLACE A GUIDE UNIT IN A CONTINUOUS CASTING MACHINE

(71) Applicant: DANIELI & C. OFFICINE MECCANICHE S.P.A., Buttrio (IT)

(72) Inventors: Daniele Comand, Lestizza (IT); Michele Meret, Rivignano Teor (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 0 days.

(21) Appl. No.: 16/496,161

(22) PCT Filed: Mar. 23, 2018

(86) PCT No.: PCT/IT2018/050051
§ 371 (c)(1),
(2) Date: Sep. 20, 2019

(87) PCT Pub. No.: WO2018/173091
PCT Pub. Date: Sep. 27, 2018

(65) Prior Publication Data

US 2020/0139429 A1 May 7, 2020

(30) Foreign Application Priority Data

Mar. 24, 2017 (IT) ..... 102017000032906

(51) Int. Cl.
*B22D 11/128* (2006.01)

(52) U.S. Cl.
CPC ..... *B22D 11/1285* (2013.01); *B22D 11/1282* (2013.01)

(58) Field of Classification Search
CPC ..... B22D 11/128; B22D 11/1282; B22D 11/1285
USPC ..... 164/417, 441, 442, 447, 448, 413, 454, 164/484
See application file for complete search history.

(56) References Cited

U.S. PATENT DOCUMENTS 5,548,882 A * 8/1996 Windhaus et al. ..... B21B 1/466 164/417
2015/0343524 A1 12/2015 Witschas et al.

FOREIGN PATENT DOCUMENTS

JP 2000141002 A 5/2000

OTHER PUBLICATIONS

Int'l Search Report and Written Opinion dated Jun. 12, 2018 in Int'l Application No. PCT/IT2018/050051.

* cited by examiner

*Primary Examiner* — Kevin P Kerns
(74) *Attorney, Agent, or Firm* — Panitch Schwarze Belisario & Nadel LLP

(57) ABSTRACT

Apparatus to replace a guide unit in a continuous casting machine. A platform is positioned, during use, at the side of a casting line, and is provided with at least a first positioning zone of at least a first guide unit and at least a second positioning zone of at least a second guide unit. The platform is associated with a rotation device to take, on each occasion, the first positioning zone or the second positioning zone facing the side of the casting line. A movement device moves the second guide unit from a positioning zone outside the platform and, during use, in line with the casting line, to the second positioning zone of the platform and to move the first guide unit from the first positioning zone of the platform to the positioning zone outside the platform and, during use, in line with the casting line.

12 Claims, 3 Drawing Sheets

APPARATUS TO REPLACE A GUIDE UNIT IN A CONTINUOUS CASTING MACHINE

CROSS-REFERENCE TO RELATED APPLICATIONS

This application is a Section 371 of International Application No. PCT/IT2018/050051, filed Mar. 23, 2018, which was published in the English language on Sep. 27, 2018, under International Publication No. WO 2018/173091 A1, which claims priority under 35 U.S.C. § 119(b) to Italian Application No. 102017000032906, filed Mar. 24, 2017, the disclosures of each of which are incorporated herein by reference.

FIELD OF THE INVENTION

The present invention concerns an apparatus and a method for changing guide units in a continuous casting machine.

The guide units can be, for example, straightening and/or "soft reduction" units located on a determinate segment of the casting line, where the term "soft reduction" means a mechanical compression treatment of the liquid core contained inside the external skin of the bar or product being worked.

BACKGROUND OF THE INVENTION

Continuous casting machines, with one or more casting lines, are used to carry out the continuous casting of metal from a mold, so as to obtain a metal product which proceeds along a cooling path in which a curvature is provided, and then it reaches a shearing station, from which semi-finished products of various section and characteristics of size are made, for example products with a round, square, rectangular or other section. The semi-finished products can then be subjected to subsequent processes, such as rolling for example.

In document US-A-2015/0343524, for example, a known casting and hot rolling machine of strip is described. In document JP-A-2000141002 another known continuous casting machine for steel is described.

In continuous casting machines, the characteristics of size of the semi-finished products are attributed to the product primarily by a crystallizer, which receives the metal from a tundish and contains it upstream of the casting line, starting its cooling and conforming its skin, which thickens as it gradually continues downstream of the casting curve. Along this curve, the product is supported and continuously cooled by containing rolls which are reciprocally adjustable in position, separated by sprays which spray the cooling liquid onto the product.

Once the product is in proximity to the exit from the casting line, the containment continues through appropriate guide units, called straightening and soft reduction units. The straightening and soft reduction treatment allows the bar or worked product to become qualitatively optimal and thus be able to continue its journey toward the stations located downstream along the machine.

It is therefore easy to understand that it is essential to change the characteristics of size of the products according to the production batches to be obtained, in fact the crystallizer is installed in an appropriate mold suitable for quick replacement, the intermediate containment zone of the product can be replaced or regulated by the possibility of reciprocally moving the rows of containing rolls. Downstream instead, where the straightening and soft reduction units are positioned, the situation is more complicated, given the greater difficulty in managing and handling the units of straightening and soft reduction.

In fact, in order to be straightened and at the same time subjected to soft reduction, the product is worked by a variable number of these units for each casting line, which are very heavy and bulky. Generally, each straightening and soft reduction unit consists of at least two opposite rolls which determine the channel through which the product passes: they have to press the cast product externally in order to close the liquid core; then they must reshape it so that it is qualitatively in line with the desired shape. Obviously the form obtained will not differ too far from the original one and therefore there must be necessarily a suitable channel for each product, for example a round product will require a round channel, a square product instead will require a square channel, and so on. This requirement determines the need to replace the rolls of the guide units each time the size or shape of the cast product is to be changed.

In many existing plants, the straightening and soft reduction units are replaced by using cranes: first of all the units are disconnected from the clamps and the electrical and hydraulic connections, and are then hoisted one by one and taken off line. Subsequently the new units are installed, the rolls of which will allow to work a product different from the previous one.

Given the limited number of cranes that can operate in this zone at the same time, replacing the units takes quite a long time, and is also expensive and dangerous from the point of view of safety for the operators, who have to disconnect/connect the units and then constrain/release them to/from the crane, paying attention when the loads are suspended. All this without counting the time taken to bring the units, one by one, to the maintenance zone and to take new units online.

Changing the guide units in a casting line and in particular changing the straightening and soft reduction units, is therefore long, difficult to implement and negatively affects the productivity of the continuous casting machine, whether it has one or more casting lines.

As we have seen, it can therefore be required to change the straightening and soft reduction units in certain segments of the casting line, for example in order to confer on the product a shape suitable for the soft reduction treatment, or in order to carry out on the product being worked a change-in-format, or more generally, it may be required for maintenance, breakdown or other reasons.

Other limitations and disadvantages of conventional solutions and technologies will be clear to a person of skill after reading the remaining part of the present description with reference to the drawings and the description of the embodiments that follow, although it is clear that the description of the state of the art connected to the present description must not be considered an admission that what is described here is already known from the state of the prior art.

There is therefore a need to perfect an apparatus and a method for changing the guide units in a continuous casting machine which can overcome at least one of the disadvantages of the state of the art.

One purpose of the present invention is therefore to provide an apparatus for changing guide units in a continuous casting machine which allows a rapid replacement of the guide units, for example in order to carry out change-in-format operations of the product being worked, limiting intervention by operators to the utmost, and which allows to considerably increase the efficiency and productivity of the casting machine, whether it is a casting machine with one casting line, or with several casting lines.

Another purpose of the present invention is to provide an apparatus for changing guide units in a continuous casting machine which is particularly effective for changing, for example, the straightening and soft reduction units provided along the casting line, or along the casting lines.

Another purpose of the present invention is to provide an apparatus for changing guide units in a continuous casting machine which is particularly suitable for continuous casting machines able to produce semi-finished products also of various shapes or sections, for example of round, square, rectangular or other shape.

Another purpose of the present invention is to provide an efficient and rapid method for changing guide units in continuous casting machines.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purpose and according to a first aspect of the invention, an apparatus to replace a guide unit, in a continuous casting machine provided with at least one casting line, comprises at least a platform positioned, during use, at the side of the casting line, and provided with at least a first positioning zone of at least a first guide unit and at least a second positioning zone of at least a second guide unit; the platform is associated with rotation means to take, on each occasion, the first positioning zone or the second positioning zone facing the side of the casting line; the apparatus also comprises at least a first linear actuator associated with the first guide unit and at least a second linear actuator associated with the second guide unit; the linear actuators are housed on board the platform; the second linear actuator is configured to move the second guide unit from a positioning zone outside the platform and, during use, in line with the casting line, to the second positioning zone of the platform and the first linear actuator is configured to move the first guide unit from the first positioning zone of the platform to the positioning zone outside the platform and, during use, in line with the casting line, or vice versa.

According to another aspect of the invention, the first and second linear actuators are housed inside the platform and the platform comprises at least a first slit able to at least partly house a mobile shaft of the first linear actuator and at least a second slit able to at least partly house a mobile shaft of the second linear actuator.

The first and second slits can be directed in a transverse direction with respect to the direction of the casting line.

The first slit can be made on the first positioning zone and the second slit can be made on the second positioning zone.

In some embodiments, the first and the second slits are disposed at 180° one with respect to the other on said platform.

Preferably, the first and second slits are able to be aligned, during use, with at least one slit made in the casting line.

According to other aspects of the invention, the first and second guide units are positioned on corresponding support benches able to selectively occupy the first positioning zone or the second positioning zone of the platform and, during use, the positioning zone of the casting line.

In some embodiments, the shaft of each linear actuator is associated with a corresponding support bench by means of connection means.

The platform can also comprise sliding guides of the guide units directed in a direction substantially transverse with respect to the direction of the casting line.

Moreover, the sliding guides are able to align with sliding guides made in the casting line.

The invention also concerns a method to replace a guide unit in a continuous casting machine, provided with at least one casting line having guide units located one after the other; the present method provides to:

position adjacent to the casting line at least one rotatable platform on which at least a first guide unit is housed in a first positioning zone; the platform has a second positioning zone free and facing directly onto a zone of the casting line where at least a second guide unit is positioned; the first guide unit is associated with at least a first linear actuator housed on board the platform and the second guide unit is associated with at least a second linear actuator housed on board the platform;

extract the second guide unit from the zone of the casting line by means of the second linear actuator and take it into the second positioning zone provided on the platform, thus leaving free the zone of the casting line;

rotate the rotatable platform so as to take the first guide unit in proximity to the zone of the casting line;

insert the first guide unit, by means of the first linear actuator, on the zone of the casting line.

The present invention also concerns a continuous casting machine, provided with at least one casting line having guide units in line with the casting line; the machine comprises at least an apparatus to replace at least a guide unit in line with at least a guide unit offline.

In some embodiments, the replacement apparatus is positioned in proximity to a zone for the straightening and soft reduction of the product being worked in the machine.

These and other aspects, characteristics and advantages of the present disclosure will be better understood with reference to the following description, drawings and attached claims. The drawings, which are integrated and form part of the present description, show some forms of embodiment of the present invention, and together with the description, are intended to describe the principles of the disclosure.

The various aspects and characteristics described in the present description can be applied individually where possible. These individual aspects, for example aspects and characteristics described in the attached dependent claims, can be the object of divisional applications.

It is understood that any aspect or characteristic that is discovered, during the patenting process, to be already known, shall not be claimed and shall be the object of a disclaimer.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

We shall now refer in detail to the various embodiments of the present invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

Before describing these embodiments, we must also clarify that the present description is not limited in its application to details of the construction and disposition of the components as described in the following description using the attached drawings. The present description can provide other embodiments and can be obtained or executed in various other ways. We must also clarify that the phraseology and terminology used here is for the purposes of description, and cannot be considered as limitative.

Figure 1:
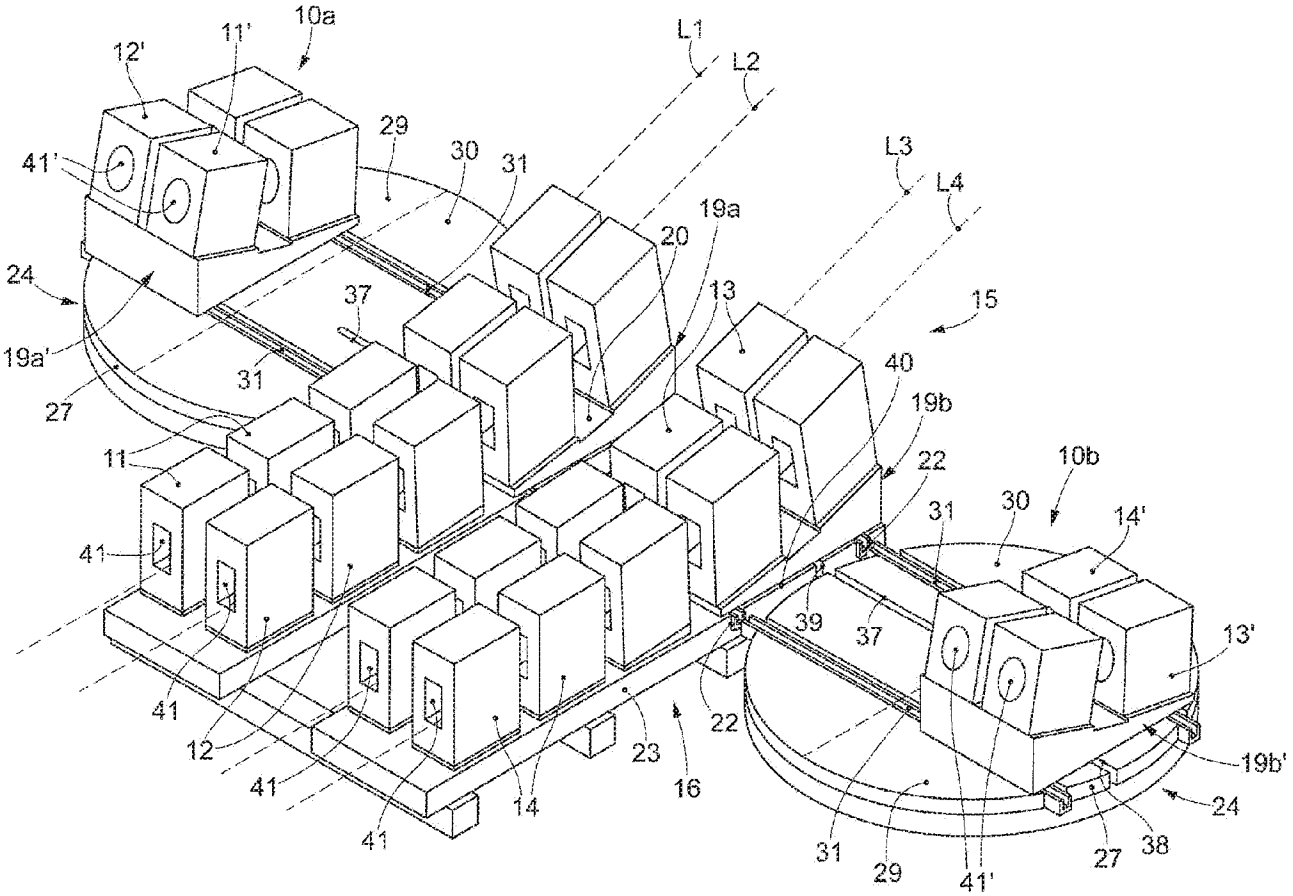
FIG. 1 is a schematic three-dimensional view of a pair of replacement apparatuses for guide units according to the invention applied to a continuous casting machine, for example with several casting lines.

With reference to the attached drawings, FIG. 1 shows a pair of apparatuses 10*a* and 10*b* for replacing guide units 11, 12 and 13, 14 in a continuous casting machine 15.

The continuous casting machine 15 comprises, in the example of FIG. 1, four casting lines L1, L2, L3 and L4, schematically identified by lines of dashes, on which the guide units 11, 12, 13, 14 are disposed in sequence. The guide units 11, 12, 13, 14 are therefore online guide units, that is, operational during use.

Each of the apparatuses 10*a* and 10*b* is used, in this example, for replacing guide units in a corresponding pair of casting lines, so the apparatus 10*a* is used for replacing the guide units 11 and 12 of the casting lines L1 and L2, while the apparatus 10*b* is used for replacing the guide units 13 and 14 of the casting lines L3 and L4.

It should be pointed out immediately that the continuous casting machine 15 could comprise a single casting line, for example the casting line L1, thus comprising a single row of guide units 11: in this case, the apparatus 10*a* will be used for replacing one or more guide units 11 in the casting line L1.

The guide units 11, 12, 13 and 14 are suitable to guide the bar or product being worked along the continuous casting machine 15, by means of suitable guide holes 41 through which the bar passes.

In the machine 15 shown in FIG. 1, it has been hypothesized that the guide holes 41 of all the guide units 11, 12, 13 and 14 of the casting lines L1, L2, L3 and L4 are of the same shape and size, for example rectangular.

Figure 2:
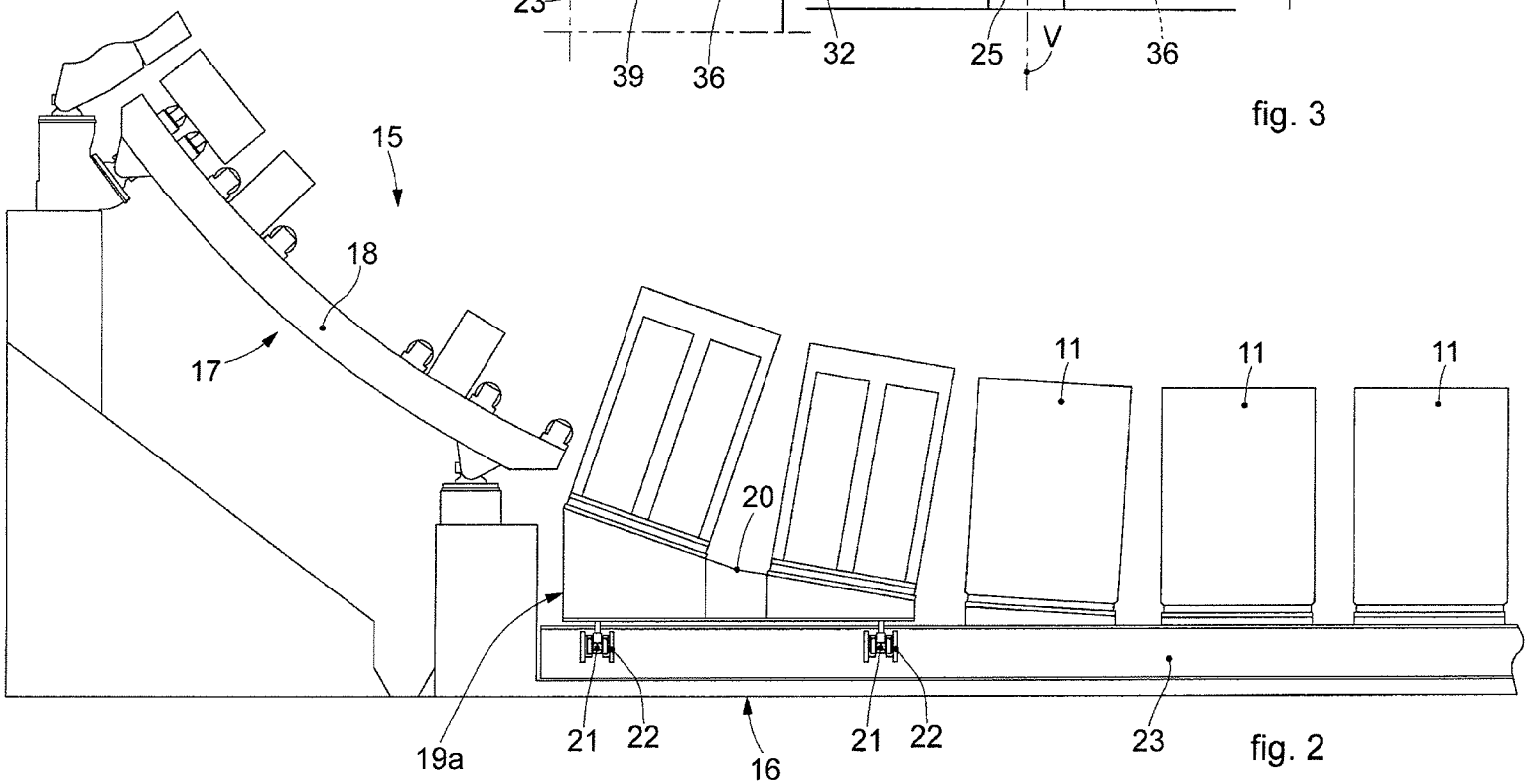
FIG. 2 is a schematic view in lateral elevation of part of a continuous casting machine according to the invention.

The guide units 11, 12, 13, 14 can be guide units positioned in a straightening and soft reduction zone 16 of the bar, which is located downstream of a guide and cooling zone 17 of the bar, see also FIG. 2. In the guide and cooling zone 17, as it is known, a chute 18 is provided suitably inclined, along which the bar descends, cooling down.

In proximity to the entrance of the straightening and soft reduction zone 16 there is a bench 19*a* or 19*b*, which has a suitably inclined supporting surface 20 for the guide units 11, 12 or 13, 14.

If the bench 19*a* or 19*b* was disposed in another part of the straightening and soft reduction zone 16, or in another zone of the machine 15, it could be without inclination, and therefore have a substantially flat supporting surface.

The bench 19*a* or 19*b* is provided with sliding elements 21, for example wheels, pads or suchlike, inserted into suitable guides 22 made in a base 23 of the straightening and soft reduction zone 16.

The guides 22 are directed substantially in a transverse direction with respect to the direction along which the casting lines L1, L2, L3, and L4 develop, and along which the guide units 11, 12, 13 and 14 are disposed.

As can be seen, by way of example, the bench 19*a* or 19*b* supports a certain number of guide units of one or more casting lines. In this case it is provided that the bench 19*a* supports the guide units 11 and 12 of the casting lines L1 and L2 and the bench 19*b* supports the guide units 13 and 14 of the casting lines L3 and L4.

Figure 3:
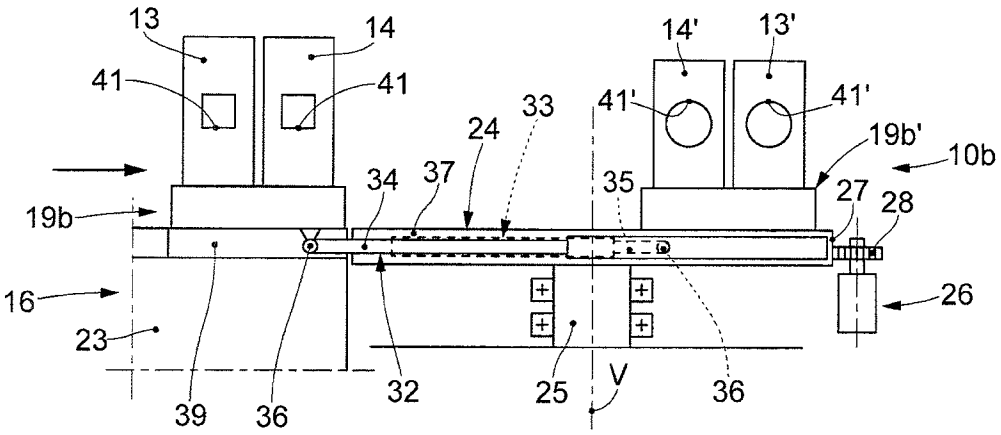
FIG. 3 is a schematic front view of the present replacement apparatus located at the side of the continuous casting machine.

The apparatus 10*a* or 10*b* for replacing guide unit 11, 12, 13 and 14 comprises a platform 24, see also FIG. 3, positioned on a support 25 which allows it to rotate around an axis V.

The support 25 could be associated with rotation means of the platform 24, or be provided with a rotating shaft connected to the platform 24 and to suitable rotation means.

Alternatively, it is possible to provide rotation means 26 outside the platform 24 and able to engage with the periphery 27 of the platform 24 so as to rotate it, in one direction or the other. In this case the platform 24 will have a circular shape.

For example, it can be supposed that the rotation means 26 comprise a pinion 28 able to engage on a corresponding toothing made on the periphery 27 of the platform 24.

Naturally, it would be possible to provide that the rotation means 26 drive the platform 24 by means of other motion transmission elements or means, such as belts, gears or suchlike.

On the surface of the platform 24 it is possible to identify a first positioning zone 29 in which a bench 19*a*' or 19*b*' is housed, to support guide units 11', 12', 13', 14', that is, guide units which are located outside the casting machine 15 and therefore, in this case, off line.

On the platform 24 it is also possible to identify a second positioning zone 30 which is free in FIG. 1 and, as we will see, it will be able to house the bench 19*a* or 19*b* of the guide units 11, 12, 13, 14, once extracted from the casting lines L1, L2, L3, L4.

The guide units 11', 12', 13', 14' can be provided with a guide hole 41' of a different shape from the guide hole 41 of the guide units 11, 12, 13, 14, therefore, for example a guide hole 41' with a circular shape and suitable for a soft reduction treatment of the bar or product being worked which will pass between the guide units 11', 12', 13', 14' once positioned on the casting lines L1, L2, L3 and L4.

The guide units 11', 12', 13', 14' could also be provided with guide holes of different shape and size, for example to effect a change-in-format of the product being worked, if the guide units 11', 12', 13', 14' were inserted in the casting machine at the bottom of the straightening and soft reduction zone 16, or in another zone of the continuous casting machine 15.

The zones 29 and 30 of the platform 24 are passed through by guides 31 supporting the benches 19*a*' and 19*b*', which will be provided with corresponding sliding pads in said guides 31.

The guides 31 are able to align, in at least two positions of the platform 24, with the guides 22 made in the base 23 of the straightening and soft reduction zone 16.

The apparatus 10*a* or 10*b* comprises at least a first linear actuator 33 associated with at least one guide unit 11', 12', 13', 14' and at least one second linear actuator 32 associated with at least one guide unit 11, 12, 13, 14.

The linear actuators 32 and 33 are both housed on board the platform 24.

The benches 19*a*, 19*b*, 19*a*' and 19*b*' can be translated along the guides 22 and 31 by means of the linear actuators 32 and 33, which can be, for example, pneumatic, hydraulic or similar linear actuators, see FIG. 3 for example.

In particular, the linear actuators 32 and 33 are housed inside the platform 24, in staggered positions, and each of them comprises at least one removable shaft 34 and 35 connected to the bench 19*b* and 19*b*'.

The shaft 34 or 35 of the linear actuator 32 or 33 is connected to the corresponding bench 19*b* or 19*b*' by suitable connection means 36, for example pins or suchlike.

The shafts 34 and 35 can slide in corresponding slits 37, 38 made in the platform 24 in both positioning zones 29 and 30: a first slit 37 is made in the positioning zone 30 able to accommodate a bench 19*b* which can be extracted from the casting lines L3 and L4, see FIG. 2 for example, and a slit 38 is made in the positioning zone 29 occupied by the bench 19*b*', provided with the guide units 13' and 14'.

The slits 37 and 38 are made on the platform so as to selectively align with guide slits 39 made on the base 23.

The linear actuators 32 and 33 are therefore substantially housed inside the platform 24 in a zone below, respectively, in the slits 37 and 38.

Substantially therefore, in the embodiment shown, the shafts 34 and 35 of the linear actuators 32 and 33 are connected below to the base of the benches 19*b* and 19*b*' by means of the connection means 36, so as to allow a two-directional translation of the benches 19*b* and 19*b*' resting on the base 23 and on the platform 24.

In the situation of FIG. 3, the shaft 34 of the linear actuator 32 is extracted and is partly housed in the slit 39 of the base 23 and partly in the slit 37 made in the positioning zone 30.

The shaft 35 of the linear actuator 33 is instead retracted and is housed in the slit 38 of the positioning zone 29, where the bench 19*b*' is housed.

The linear actuators 32 and 33 therefore, substantially, allow a translation of the benches 19*b* or 19*b*' inside and outside the platform 24, or vice versa, so that they can be extracted or inserted automatically into the casting lines L3 and L4 of the continuous casting machine 15.

In exactly the same way, the linear actuators 32 and 33 will be provided for the platform 24 of the apparatus 10*a*, which operates to replace the guide units 11 and 12 with the guide units 11' and 12', or vice versa, of the casting lines L1 and L2 of the continuous casting machine 15.

We again reiterate that the apparatus 10*b* or 10*a* could allow the replacement of one or more guide units even just for one casting line, for example, see FIG. 1 and FIG. 3, and it is hypothesized to provide only the casting line L4 with guide units 14 and the guide units 14' located on the platform 24, for example by means of the corresponding support benches 19*b* and 19*b*'.

By way of example, the sequence of FIGS. 4*a*-4*d* show how the guide units 13 and 14 provided in the casting lines L3 and L4 are replaced by the guide units 13' and 14' provided on the platform 24 of the apparatus 10*b*.

The linear actuator 32 is driven to extract the bench 19*b* from the casting lines L3 and L4, which slides by means of the elements 21 along the guides 22 of the base and then along the guides 31 of the platform 24, which are therefore aligned with said guides 22. The slit 39 of the base 23 is also aligned with the slit 37 of the platform 24, see FIG. 1.

Figure 4A:
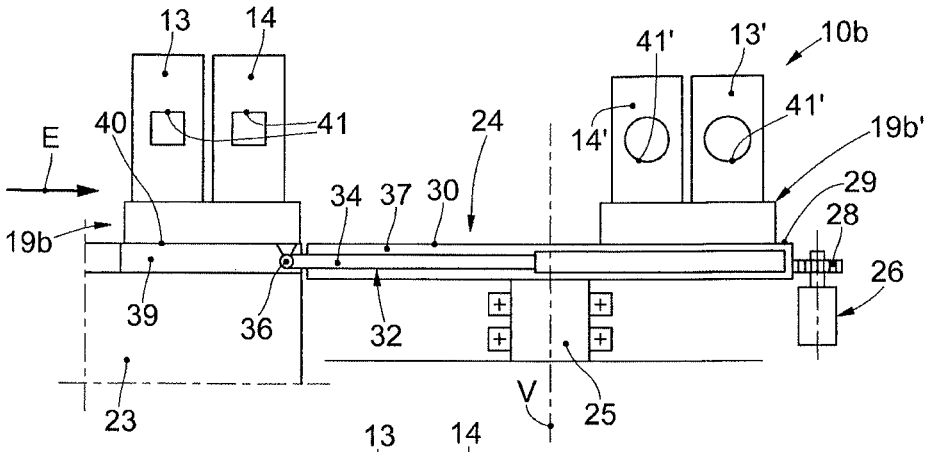
FIGS. 4*a*-4*d* are schematic front views that show a substitution sequence of guide units according to the present invention.
Figure 4B:
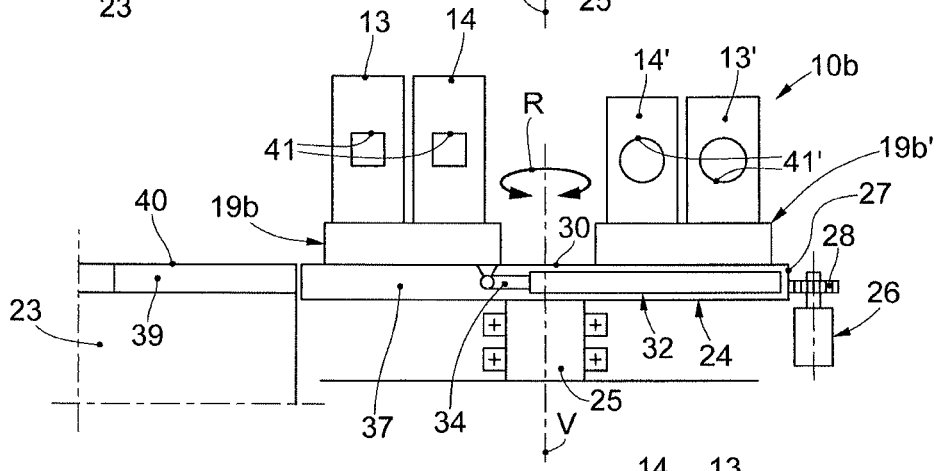

The shaft 34 of the actuator 32 therefore moves in direction E, FIG. 4*a*, and is therefore returned inside the platform 24 of the apparatus 10*b*, until the situation shown in FIG. 4*b*.

The bench 19*b*, on which the guide units 13 and 14 to be replaced are disposed, will therefore occupy the positioning zone 30, which is free.

Figure 4C:
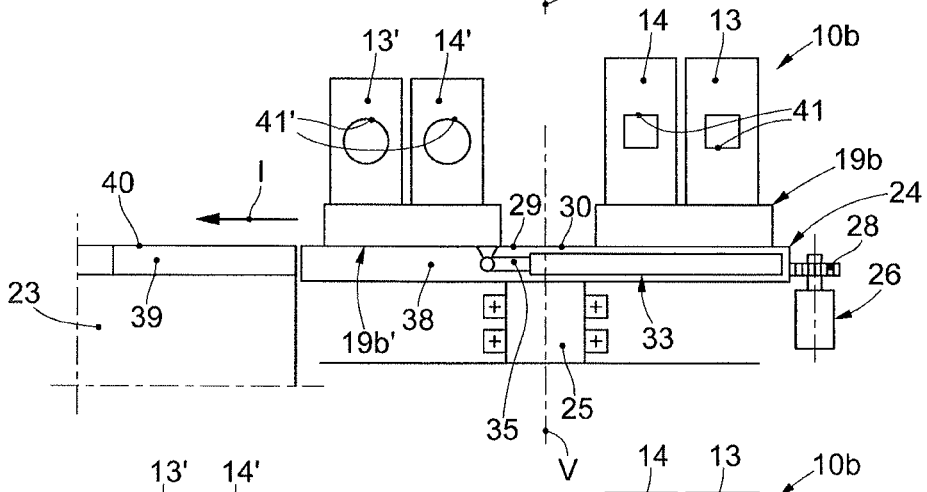

At this point, by means of the rotation means 26, the platform 24 of the apparatus 10*b* is rotated by 180°, in one direction or the other, see arrows R, so as to bring the slit 38, on which the bench 19*b*' provided with the replacement guide units 13' and 14' is housed, into alignment with the slit 39 of the base 23, see FIG. 4*c*. The guides 31 of the platform 24 and the guides 22 of the base 23 will also be aligned again.

At this point, the linear actuator 33 with which the bench 19*b*' is associated, translates the bench 19*b*' in direction I into a positioning zone 40 for the base 23. To accomplish this operation, the shaft 35 of the linear actuator 33 is extracted so as to partly occupy both the slit 38 of the platform 24 and the slit 39 of the base 23, until it reaches the situation shown in FIG. 4*d*.

The positioning zone 40 is the zone of the base 23 where the bench 19*b* was housed and which is now left free thereof, for the insertion of the bench 19*b*'.

Figure 4D:
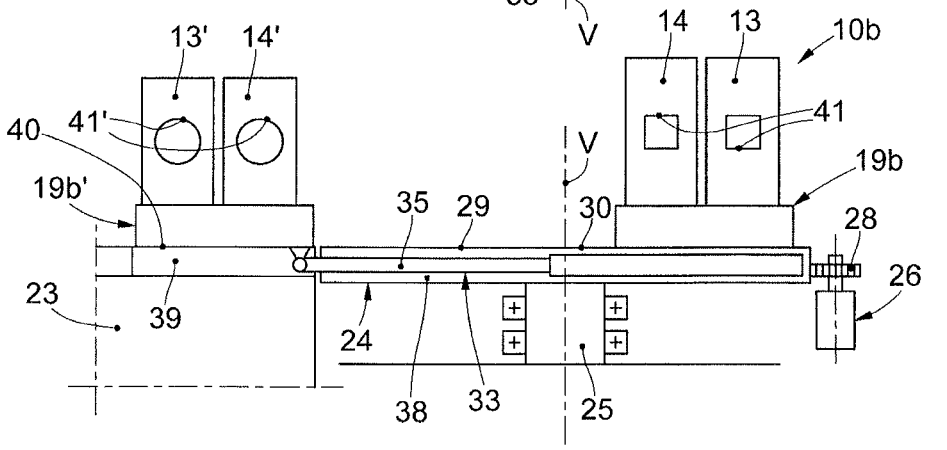

In the situation of FIG. 4*d*, the guide units 13' and 14' are located correctly aligned with the casting lines L3 and L4, in replacement of the guide units 13 and 14.

The guide units 13' and 14', as can be seen, are provided with guide holes 41' with a different shape from the guide holes 41 of the guide units 13 and 14: if the guide holes 41' are circular, then the guide units 13' and 14' can be used to carry out the soft reduction treatment of the bar or product being worked, as in the example shown; downstream of the guide units 13' and 14', guide units 13 and 14 with guide holes 41 will be provided again.

Naturally, what is described above with respect to the replacement of the guide units 13 and 14 by the replacement apparatus 10*b*, is similarly applicable in all respects for the replacement of the guide units 11 and 12 by means of the apparatus 10*a*.

The apparatus 10*a* and/or 10*b* could also be used to perform a change-in-format of the bar or product being worked, so it could also be positioned at the bottom of the straightening and soft reduction zone 16, or in any other zone whatsoever of the casting line, or lines.

It would also be possible to provide that the platform 24 of the apparatus 10*a* and/or 10*b* can be translated in a direction substantially parallel to the casting lines so as to be able to be positioned on different points of the casting machine.

As can be understood from the operating sequence shown above, the linear actuators 32 and 33 can be left constantly connected to the benches 19*a*, 19*a*', 19*b*, 19*b*', therefore, it is possible to replace the guide units 11-14 continuously and without intervention from the operators by the guide units 11'-14', or vice versa, effectively and rapidly and, as we said, also for a single casting line.

Naturally, it is possible to provide that the guide units 11-14 and 11'-14' are connected directly to the respective movement means, that is, the linear actuators 32 and 33, and therefore without using the benches 19*a*, 19*a*', 19*b*, 19*b*' shown, or providing different support means.

The linear actuators 32 and 33 could, in turn, be replaced by other movement means configured to insert and extract the guide units 11-14 and 11'-14' into and out of the casting lines, or the casting line.

It is clear that modifications and/or additions of parts may be made to the apparatus to replace guide units in a continuous casting machine as described heretofore, without departing from the field and scope of the present invention.

It is also clear that, although the present invention has been described with reference to some specific examples, a person of skill in the art shall certainly be able to achieve many other equivalent forms of apparatus to replace guide units in a continuous casting machine, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. Apparatus to replace a guide unit in a continuous casting machine (15) provided with at least one casting line (L1-L4), wherein it comprises at least a platform (24) positioned, during use, at a side of said at least one casting line (L1-L4), and provided with at least a first positioning zone (29) of at least a first guide unit (11'-14') and at least a second positioning zone (30) of at least a second guide unit (11-14), said at least a platform (24) being associated with rotation means (25, 26) to take, on each occasion, said at least a first positioning zone (29) or said at least a second positioning zone (30) facing the side of said at least one casting line (L1-L4), the apparatus also comprising at least a first linear actuator (33) associated with said at least a first guide unit (11'-14') and at least a second linear actuator (32) associated with said at least a second guide unit (11-14), said linear actuators (33, 32) being housed on board and inside the at least a platform (24), and said at least a platform (24) comprising at least a first slit (38) able to at least partly house a mobile shaft (35) of said at least a first linear actuator (33) and at least a second slit (37) able to at least partly house a mobile shaft (34) of said at least a second linear actuator (32), said at least a second linear actuator (32) being configured to move said at least a second guide unit (11-14) from a positioning zone (40) outside said at least a platform (24) and, during use, in line with said at least one casting line (L1-L4), to said at least a second positioning zone (30) of the at least a platform (24), and said at least a first linear actuator (33) being configured to move said at least a first guide unit (11'-14') from said at least a first positioning zone (29) of the at least a platform (24) to said positioning zone (40) outside said at least a platform (24) and, during use, in line with said at least one casting line (L1-L4), or vice versa.

2. Apparatus as in claim 1, wherein said at least first and second slits (38, 37) are directed in a transverse direction with respect to a direction of the at least one casting line (L1-L4).

3. Apparatus as in claim 1, wherein said at least a first slit (38) is made on said at least a first positioning zone (29) and said at least a second slit (37) is made on said at least a second positioning zone (30).

4. Apparatus as in claim 1, wherein said at least first and second slits (38, 37) are disposed at 180° one with respect to the other on said at least a platform (24).

5. Apparatus as in claim 1, wherein said at least first and second slits (38, 37) are able to be aligned, during use, with at least one slit (39) made in the at least one casting line (L1-L4).

6. Apparatus as in claim 1, wherein said at least first and second guide units (11'-14', 11-14) are positioned on corresponding support benches (19*a*', 19*b*', 19*a*, 19*b*) able to selectively occupy said at least a first positioning zone (29) or said at least a second positioning zone (30) of the at least a platform (24) and, during use, said positioning zone (40) of said at least one casting line (L1-L4).

7. Apparatus as in claim 6, wherein the shaft (34, 35) of each linear actuator (33, 32) is associated with a corresponding support bench (19*a*', 19*b*', 19*a*, 19*b*) by means of connection means (36).

8. Apparatus as in claim 1, wherein said at least a platform (24) comprises sliding guides (31) of said at least first and second guide units (11'-14', 11-14) directed in a direction substantially transverse with respect to a direction of the at least one casting line (L1-L4).

9. Apparatus as in claim 8, wherein said sliding guides (31) are able to align with sliding guides (22) made in the at least one casting line (L1-L4).

10. Method to replace a guide unit in a continuous casting machine (15), provided with at least one casting line (L1-L4) having guide units (11-14) located one after the other, wherein it provides to:

position adjacent to the at least one casting line (L1-L4) at least one rotatable platform (24) on which at least a first guide unit (11'-14') is housed in a first positioning zone (29), said at least one platform (24) having a second positioning zone (30) free and facing directly onto a zone (40) of said at least one casting line (L1-L4) where at least a second guide unit (11-14) is positioned, said at least a first guide unit (11'-14') being associated with at least a first linear actuator (33) housed on board and inside the at least one platform (24) and said at least a second guide unit (11-14) being associated with at least a second linear actuator (32) housed on board and inside the at least one platform (24), said at least one platform (24) comprising at least a first slit (38) able to at least partly house a mobile shaft (35) of said at least a first linear actuator (33) and at least a second slit (37) able to at least partly house a mobile shaft (34) of said at least a second linear actuator (32);

extract said at least a second guide unit (11-14) from said zone (40) of said at least one casting line (L1-L4) by means of said at least a second linear actuator (32) and take it into said second positioning zone (30) provided on said at least one platform (24), thus leaving free said zone (40) of said at least one casting line (L1-L4);

rotate said at least one platform (24) so as to take said at least a first guide unit (11'-14') in proximity to said zone (40) of said at least one casting line (L1-L4);

insert said at least a first guide unit (11'-14'), by means of said at least a first linear actuator (33), on said zone (40) of said at least one casting line (L1-L4).

11. Continuous casting machine, wherein it comprises at least a replacement apparatus (10*a*, 10*b*) to replace at least a second guide unit (11-14) in line with at least a first guide unit (11'-14') offline comprising:

at least a platform (24) positioned, during use, at a side of said at least one casting line (L1-L4), and provided with at least a first positioning zone (29) of the at least a first guide unit (11'-14') and at least a second positioning zone (30) of the at least a second guide unit (11-14), said at least a platform (24) being associated with rotation means (25, 26) to take, on each occasion, said at least a first positioning zone (29) or said at least a second positioning zone (30) facing the side of said at least one casting line (L1-L4), the apparatus also comprising at least a first linear actuator (33) associated with said at least a first guide unit (11'-14') and at least a second linear actuator (32) associated with said at least a second guide unit (11-14), said linear actuators (33, 32) being housed on board and inside the at least a platform (24), and said at least a platform (24) comprising at least a first slit (38) able to at least partly house a mobile shaft (35) of said at least a first linear actuator (33) and at least a second slit (37) able to at least partly house a mobile shaft (34) of said at least a second linear actuator (32), said at least a second linear actuator (32) being configured to move said at least a second guide unit (11-14) from a positioning zone (40) outside said at least a platform (24) and, during use, in line with said at least one casting line (L1-L4), to said at least a second positioning zone (30) of the at least a platform (24), and said at least a first linear actuator (33) being configured to move said at least a first guide unit (11'-14') from said at least a first positioning zone (29) of the at least a platform (24) to said positioning zone (40) outside said at least a platform (24) and, during use, in line with said at least one casting line (L1-L4), or vice versa.

12. Continuous casting machine as in claim 11, wherein said replacement apparatus (10*a*, 10*b*) is positioned in a zone (16) for straightening and soft reduction of a product being worked in the machine.

* * * * *